United States Patent [19]

Dill et al.

[11] 3,958,641

[45] May 25, 1976

[54] SELF-DECENTRALIZED HYDRA-JET TOOL

[75] Inventors: Floyd E. Dill; Bert O. Brown, both of Midland, Tex.

[73] Assignee: Halliburton Company, Duncan, Okla.

[22] Filed: Mar. 7, 1974

[21] Appl. No.: 448,836

[52] U.S. Cl. ..... 166/312; 166/223; 175/422; 239/229; 299/17

[51] Int. Cl.[2] ..... E21B 21/00; E21B 37/00

[58] Field of Search ..... 137/68; 166/50, 169, 166/177, 222, 223, 244 R, 305 R, 310, 312; 175/231, 422; 239/DIG. 13, 203, 204, 229; 285/2, 3, 4; 299/17; 23/272 AH

[56] References Cited

UNITED STATES PATENTS

| | | | |
|---|---|---|---|
| 1,715,767 | 6/1929 | Le Flore | 166/223 |
| 1,780,428 | 11/1930 | Larsen | 166/222 |
| 2,117,648 | 5/1938 | Bottorf | 166/222 |
| 2,179,017 | 11/1939 | Pieper | 166/223 |
| 2,257,765 | 10/1941 | Scaramucci | 166/222 |
| 3,020,958 | 2/1962 | Kenneday | 166/312 |
| 3,052,298 | 9/1962 | Malott | 166/312 |
| 3,070,361 | 12/1962 | Pew | 299/17 |
| 3,163,226 | 12/1964 | Lagucki | 166/312 |
| 3,279,543 | 10/1966 | Yetman | 166/312 |
| 3,529,684 | 9/1970 | Hill | 175/422 |

*Primary Examiner*—Ernest R. Purser
*Assistant Examiner*—Jack E. Ebel
*Attorney, Agent, or Firm*—John H. Tregoning; Bruce E. Burdick

[57] ABSTRACT

A self-decentralized hydra-jet tool for jet treating the face of a formation penetrated by a well bore which tool includes a jet treating head assembly adapted to be lowered into a well bore and supported therein by a flexible conduit assembly communicating between the jet treating head assembly and a source of pressurized treating fluid, the jet treating head assembly including a plurality of jet nozzles therein arranged such that a force imbalance is imparted to the jet treating head assembly by the reaction forces resulting from the jet action of the nozzles thereby urging the jet treating head assembly into close proximity to the formation face being treated. Also disclosed is apparatus for releasably housing the flexible conduit assembly within the lower end of a tubing string and releasable connecting means for supporting the jet treating head assembly at the lower end of the tubing string until fluid pressure of predetermined magnitude is applied to the tubing string to release the connecting means and extend the hydra-jet tool from the lower end of the tubing string. Methods employing the tool are also disclosed.

19 Claims, 9 Drawing Figures

SELF-DECENTRALIZED HYDRA-JET TOOL

BACKGROUND OF THE INVENTION

1. Field of the Invention

This invention relates generally to improvements in oil and gas well stimulation, and, more particularly, but not by way of limitation, to improvements in stimulation of oil and gas wells by means of hydra-jet treatment.

2. Description of the Prior Art

The employment of the hydra-jet technique for perforating cased holes, cutting slots or windows in casing and beyond in the formation, cutting pipe for removal, removing cement and debris from casing or open hole, underreaming, formation washing and removal of scale and debris from old perforations is well known in the oil and gas industry. To perform the various processes mentioned above, a great number of hydra-jet tools have been developed for use in the industry. These tools generally employ a jet treating head having one or more nozzles formed therein communicating between the exterior and interior of the jet treating heads. These jet treating heads are secured to the lower end portion of a rigid tubing string which supports the jet treating head adjacent the area to be treated and provides communication between the jet treating head and the ground surface through which pressurized treating fluid is pumped. Various fluids are employed in hydra-jet servicing such as abrasive laden liquids, acids and other chemical solutions adapted to the specific well servicing job being performed.

The known hydra-jet tools and methods have been shown to be somewhat deficient when treating, or attempting to treat, producing formations which have been fractured by explosive and acidized thereby creating an extended stand-off distance from the axis of the well bore to the face of the formation which is to be perforated, cut, acidized or otherwise treated by means of hydra-jet equipment.

The problem of extended stand-off distance is aggravated by the relatively small diameter of the casing in many older wells coupled with the centralization imparted by both the rigidity of the tubing string and the centralizer placed on the tubing string and near the prior art hydra-jet treating tools thereby restricting the positioning of the jet treating tool at a more effective reduced stand-off distance in cased holes, and more specifically, in shot cased holes and acidized or shot open holes.

It is the overcoming of the extended stand-off distance encountered in hydra-jet stimulation of older, previously acidized or shot cased or open holes which has created the requirement for the present invention which provides an economical and reliable solution to the problem of reducing the extended stand-off distance between a hydra-jet treating tool and the face of a formation requiring hydra-jet treatment service.

SUMMARY OF THE INVENTION

The present invention contemplates a self-decentralized hydra-jet tool for use with a source of pressurized treating fluid for jet treating well bores or the like which comprises a flexible conduit positionable within the well bore and which has an upper end portion and a lower end portion. The apparatus also includes connecting means on the upper end portion of the flexible conduit for connecting the conduit in communication with the source of pressurized treating fluid. Also included is a jet treating head having a cavity formed therein for connecting the lower end portion of the flexible conduit to the jet treating head in communication with the cavity formed therein. First nozzle means is formed in the jet treating head and extends outwardly from the cavity therein in a first direction for ejecting pressurized treating fluid therethrough in the first direction and exerting an opposite reaction force on the jet treating head. Second nozzle means is formed in the jet treating head and extends outwardly from the cavity in a second direction substantially opposite to the first direction of the first nozzle means for ejecting pressurized treating fluid therethrough from the jet treating head in a second direction and exerting an opposite reaction force on the jet treating head greater than the opposite reaction force associated with the first nozzle means.

An object of the invention is to provide a self-decentralized hydra-jet tool exhibiting increased efficiency in the jet treating of formations penetrated by a well bore.

Another object of the invention is to provide a hydra-jet tool which provides self-decentralization relative to the well bore to reduce the stand-off distance between the tool and the face of the formation being treated.

A further object of the invention is to provide a hydra-jet tool which more efficiently utilizes treatment chemicals and horsepower.

A still further object of the invention is to provide a hydra-jet tool capable of improved chemical and hydraulic removal of deposits in producing formations.

A still further object of the invention is to provide a self-decentralized hydra-jet tool which is economical in construction and reliable in operation.

The invention will be described not by way of limitation but rather by way of example only in terms of the preferred embodiment shown in the following detailed description when read in conjunction with the accompanying drawings, from which other objects and advantages will become evident.

DESCRIPTION OF THE PREFERRED EMBODIMENT

Figure 1:
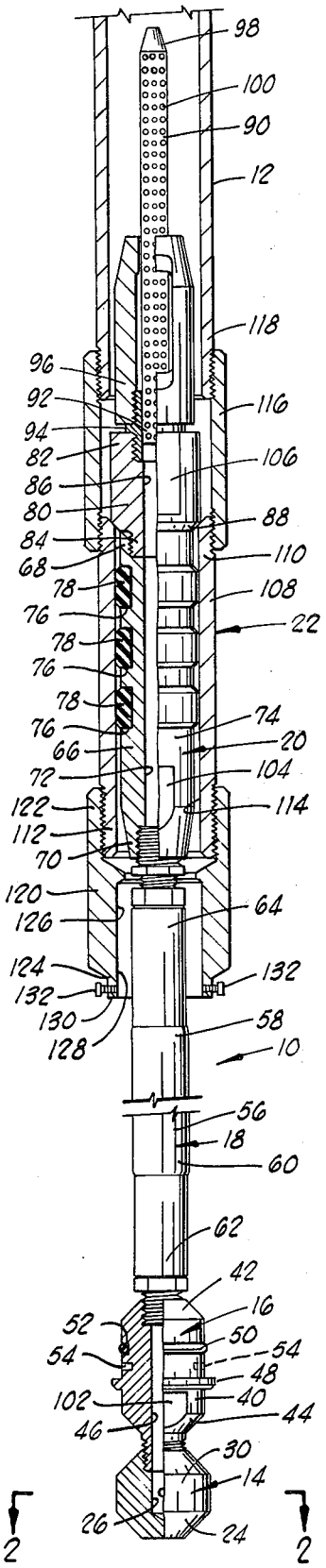
FIG. 1 is an elevational view in partial cross-section illustrating the hydra-jet tool of the present invention installed on the lower end of a tubing string and telescopically extended relative to the tubing string.

Referring now to the drawing, and to FIG. 1 in particular, a preferred embodiment of the self-decentralized hydra-jet tool of the present invention is generally designated by the reference character 10. The tool 10 is mounted on the lower end portion of a tubing string 12.

The tool 10 comprises a jet treating head assembly 14, a tubular adaptor assembly 16 connected to the jet treating head assembly 14, a flexible conduit assembly 18 interconnecting the tubular adaptor assembly 16 and a tubular support assembly 20. The tool 10 further comprises a housing 22 slidably disposed about the flexible conduit assembly 18 and the tubular support assembly 20.

Figure 2A:
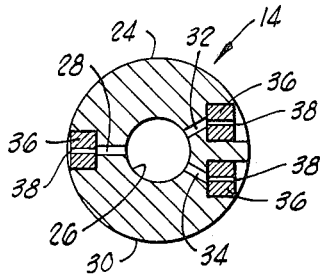
FIG. 2A is an enlarged cross-sectional view taken along line 2—2 of FIG. 1 illustrating the nozzle orientation in the jet treating head assembly.
Figure 2B:
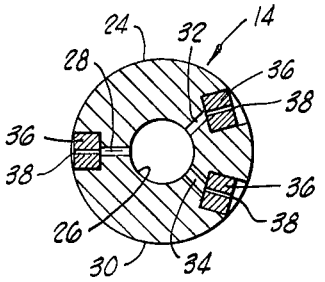
FIG. 2B is an enlarged cross-sectional view similar to FIG. 2A illustrating a slight variation in nozzle orientation in the jet treating head assembly.
Figure 2C:
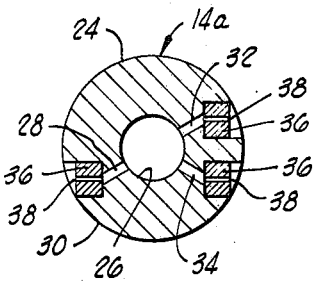
FIG. 2C is an enlarged cross-sectional view similar to FIG. 2A illustrating an alternate jet treating head assembly configuration providing self-rotating characteristics.

The jet treating head assembly 14 includes a head member 24 having a cavity 26 formed therein. A treating nozzle passageway 28 is formed in the head member 24 and communicates between the cavity 26 and the outer periphery 30 of the head member 24. Two reaction nozzle passageways 32 and 34 also communicate between the cavity 26 and the outer periphery 30 of the head member 24 and extend from the cavity 26 in a direction substantially opposite to the direction the treating nozzle passageway 28 extends from the cavity 26. Each of the nozzle passageways 28, 32 and 34 preferably includes a relatively hard, abrasive-resistant nozzle insert 36 secured therein with a passageway or bore 38 formed in each insert 36 providing communication between the respective nozzle passageway and the exterior of the head member 24. FIGS. 2A, 2B and 2C illustrate three slightly different positional arrangements of the treating and reaction nozzle passageways and nozzle inserts in the jet treating head assembly 14.

The tubular adaptor assembly 16 comprises a substantially cylindrical adaptor body 40 having an upper end portion 42 and a lower end portion 44 and having a longitudinal passageway extending therethrough and communicating with the upper and lower end portions. The lower end portion 44 is threadedly secured to the jet treating head assembly 14 placing the longitudinal passageway 46 in communication with the cavity 26 of the jet treating head assembly 14. The adaptor body 40 also includes an outwardly extending annular flange 48 formed on the outer periphery thereof intermediate the upper and lower end portions 42 and 44. A resilient annular seal member 50 is carried in an annular groove 52 formed in the adaptor body 40 intermediate the flange 48 and the upper end portion 42. A plurality of blind holes 54 extend radially inwardly into the adaptor body 40 intermediate the annular seal member 50 and the outwardly extending flange 48 and are adapted to receive the ends of shearable pins, rivets or screws therein as will be described more fully hereinafter.

The flexible conduit assembly 18 comprises an elongated flexible tubular conduit member 56 having an upper end portion 58 and a lower end portion 60. The flexible tubular conduit member 56 is preferably formed of high-pressure, reinforced rubber hose. Hose suitable for this application is manufactured by Stratoflex, Inc. and is designated as SF 238 hose.

A high pressure hose fitting 62 is connected to the lower end portion 60 of the flexible tubular member 56 and is in turn threadedly secured to the upper end portion 42 of the tubular adaptor assembly 16 placing the flexible conduit assembly 18 in communication with the passageway 46 of the tubular adaptor assembly 16. Another high pressure hose fitting 64 is connected to the upper end portion 58 of the flexible tubular conduit member 56.

The length of the flexible conduit assembly 18 may be varied for various jet treating applications depending on the characteristics of the formation to be treated, however, a length of approximately ten feet has been found to provide satisfactory results in the employment of the tool 10.

The tubular support assembly 20 comprises a lower tubular member 66 having an upper end portion 68, a lower end portion 70 and a longitudinal passageway 72 extending therethrough and communicating between the upper and lower end portions 68 and 70. Lower tubular member 66 includes a substantially cylindrical outer periphery 74 having a plurality of annular grooves 76 formed therein intermediate the upper and lower end portions 68 and 70 in which annular resilient seal members 78 are carried. The lower end portion 70 of the lower tubular member 66 is threadedly secured to the hose fitting 64 of the flexible conduit assembly 18 to provide communication between the passageway 72 and the flexible conduit assembly 18.

The tubular support assembly 20 further includes a no-go shoe 80 having an upper end portion 82 and lower end portion 84 with a longitudinal passageway 86 extending therethrough and communicating between the upper and lower end portions 82 and 84. The lower end portion 84 is threadedly secured to the upper end portion 68 of the lower tubular member 66 thereby placing the longitudinal passageways 86 and 72 in communication. An outwardly extending annular shoulder 88 is formed on the lower end portion 84 of the no-go shoe 80 providing means for engagement with the housing 22 as will be described more fully hereinafter.

The tubular support assembly 20 further includes a tubular strainer or filter 90 secured at the lower end portion 92 thereof to the upper end portion 82 of the no-go shoe 80 by means of threaded connectors 94 and 96. The strainer 90 is closed at its upper end 98 and includes a plurality of perforations 100 formed therein providing communication between the interior and exterior of the strainer 90. The interior of the strainer 90 is in communication with the passageway 86 of the no-go shoe 80. The perforations 100 are preferably formed each with a diameter less than the diameter of the passageways 38 in the nozzle inserts 36 to prevent foreign matter from inadvertently plugging the passageways during the operation of the self-decentralized hydra-jet tool 10.

The adaptor assembly 16 and the tubular support assembly 20 are preferably equipped with wrench flats 102, 104 and 106 to facilitate assembly and disassembly of the hydra-jet tool 10.

The housing 22 comprises a tubular member 108, a tubing coupling 116 and a tubing collar 120. Tubular member 108 has an upper end portion 110, a lower end portion 112 and a cylindrical longitudinal passageway 114 extending therethrough and communicating between the upper end portion 110 and the lower end portion 112. The tubing coupling 116 is threadedly secured to the upper end portion 110 of the tubular member 108 and provides means for threadedly securing the self-decentralized hydra-jet tool 10 to the lower end portion 118 of the tubing string 12 thereby placing the seating nipple assembly 22 in communication with the tubing string 12. The tubular collar 120 has an upper end portion 122 threadedly secured to the lower end portion 112 of the tubular member 108. The tubular collar 120 also includes a lower end portion 124 and a longitudinal passageway 126 extending therethrough providing communication between the lower end portion 124 and the upper end portion 122. The passageway 126 includes a lower portion 128 having a cylindrical inner periphery and extending upwardly from the lower end face 130 of the tubular collar 120. The diameter of the lower portion 128 is sized to slidingly receive the portion of the adaptor body 40 intermediate the annular flange 48 and the upper end portion 42 therein with the resilient annular seal member 50 providing sealing engagement between the lower portion 128 of the passageway 126 and the tubular adaptor assembly 16 as will be explained more fully hereinafter.

Figure 3:
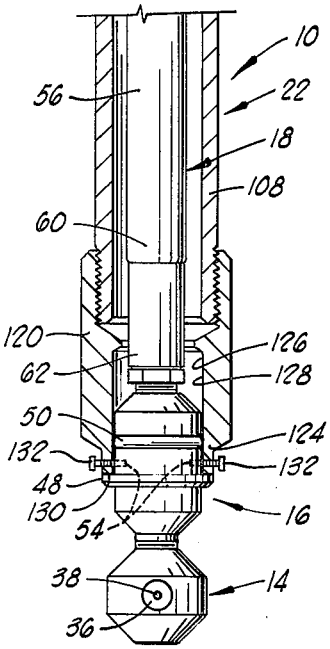
FIG. 3 is a partial elevational view in partial cross-section illustrating preferred embodiment the hydra-jet tool of the present invention telescopically retracted and releasably held within a housing.

The tubular collar 120 further includes a plurality of shearable pins, screws or rivets 132 extending radially through the lower end portion 124 thereof to be received in the corresponding blind holes 54 formed in the adaptor body 40 of the tubular adaptor assembly 16 as illustrated in FIG. 3.

It should also be noted that the diameter of the cylindrical inner periphery of the longitudinal passageway 114 of the tubular member 108 is sized to slidingly receive the outer periphery 74 of the lower tubular member 66 therein and to sealingly engage the annular resilient seal members 78 to provide sealing engagement between the housing 22 and the tubular support assembly 20 as illustrated in FIG. 1 and as will be explained more fully hereinafter.

Operation of the Preferred Embodiment

Figures 4A, 4B, 4C:
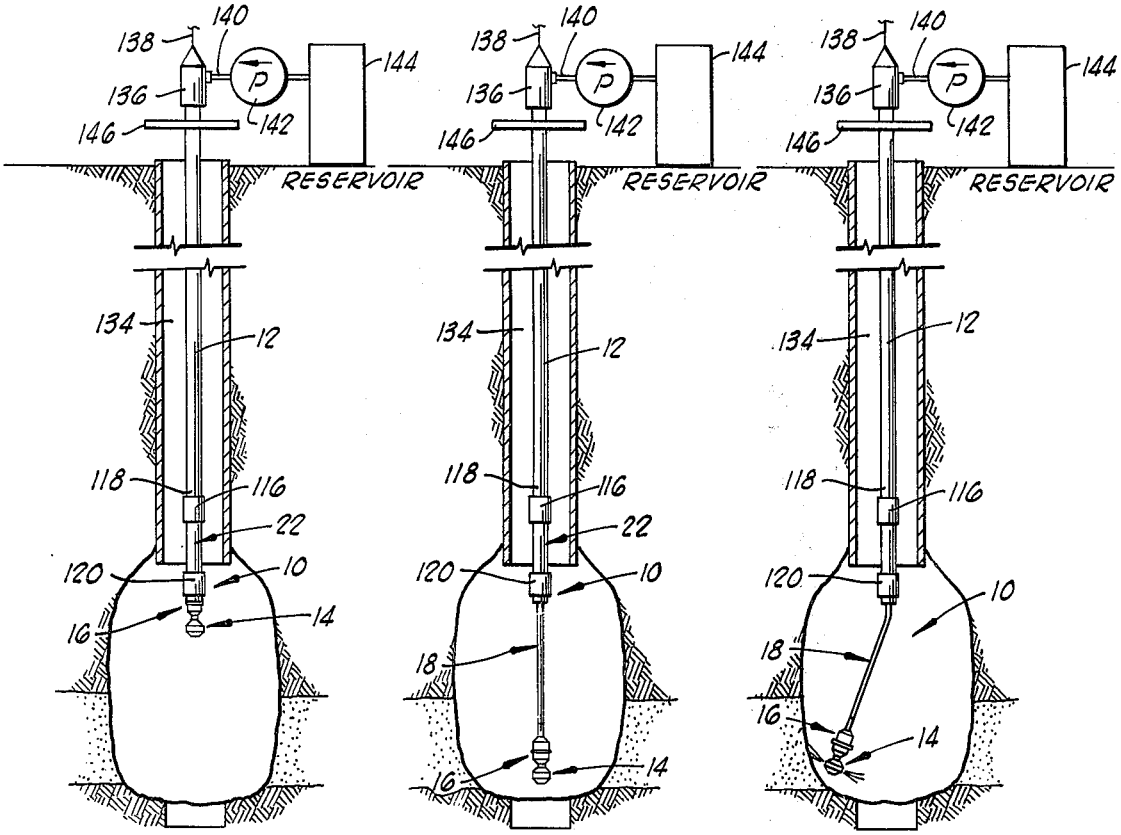
FIG. 4A is a diagrammatical elevational view of the preferred embodiment positioned in a well bore and telescopically retracted within a housing attached to the tubing string.
FIG. 4B is a diagrammatical elevational view of the preferred embodiment positioned in a well bore and telescopically extended from a housing attached to the tubing string.
FIG. 4C is a diagrammatical elevational view of the preferred embodiment positioned in a well bore telescopically extended from a housing attached to the tubing and transversely self-decentralized relative to the well bore axis into close proximity to the formation face being treated.

Referring now to FIGS. 1, 2A, 2B, 3, 4A, 4B, and 4C, the operation of the self-decentralized hydra-jet tool 10 is as follows. The tool 10 is secured to the lower end portion 118 of a tubing string 12 by means of the tubing coupling 116, as illustrated in FIG. 1. The tubular adaptor assembly 16, flexible conduit assembly 18 and tubular support assembly 20 are telescoped upwardly or retracted within the housing 22 and the tubing string 12 with the tubular adaptor assembly 16 shear pinned to the tubular collar 120 of the housing 22 by means of the shear pins, screws or rivets 132 received within the blind holes 54, as shown in FIG. 3. The tubing string 12, with the telescoped tool 10 attached thereto as described, is then lowered into a well bore 134, as shown in FIG. 4A, by suitable well known means (not shown). When the tubing string 12 has been lowered to the depth of the formation which is to be hydra-jet threated, it is then raised an amount substantially equal to the length of the flexible conduit assembly 18. The upper end portion 136 of the tubing string 12 is then supported by means of a suitable cable 138 or the like from the derrick (not shown). The upper end portion 136 of the tubing string 12 is connected via a suitable conduit 140, which will permit the free rotation of the tubing string 12 through at least 360° rotation, to a pump 142 capable of providing pressurized treating fluid to the upper end portion 136 of the tubing string 12. The pump 142 is connected by suitable conduit to a treating fluid reservoir 144.

The pump 142 is then actuated to pump treating fluid from the reservoir 144 through the tubing string 12 into the self-decentralized hydra-jet tool 10. When the pressure differential of the treating fluid across the nozzle inserts 36 reaches a predetermined level, the shear pins, screws or rivets 132 are sheared and the pressure of the treating fluid forces the hydra-jet tool 10 downwardly relative to the tubing string 12 in a telescoping manner until the annular shoulder 88 of the no-go shoe 80 engages the upper end portion 110 of the tubular member 108 of the housing 22 as illustrated in FIGS. 1 and 4B.

As the pump 142 continues to provide pressurized treating fluid through the tubing string 12 and the hydra-jet tool 10, a force differential is applied to the jet treating head assembly 14 by means of the reaction forces resulting from the jet flow of treating fluid through the treating nozzle passageway 28 and the reaction nozzle passageways 32 and 34 and their respective nozzle inserts 36. The passageways or bores 38 of the nozzle inserts 36 are preferably of substantially identical diameter and cross-section area, thereby providing a reaction force differential acting on the jet treating head assembly 14 which urges the jet treating head assembly 14 in the direction of the jet ejecting from the treating nozzle passageway 28, or to the left as viewed in FIG. 2A. This action is illustrated in FIG. 4C wherein it will be seen that the jet treating head assembly 14 is decentralized transversely to the left relative to the axis of the well bore 134 into close proximity or contact with the face of the formation to be hydra-jet treated. This transverse decentralization of the jet treating head assembly 14 is permitted by the employment of the flexible conduit assembly 18 which provides flexible support for the jet treating head assembly 14 from the tubing string 12 allowing the jet treating head to swing freely within the well bore 134.

It will be understood that other configurations and diameters of treating and reaction nozzles may be employed in a jet treating head assembly as long as they provide the necessary reaction force imbalance on the jet treating head assembly to decentralize it transversely into close proximity or contact with the formation face being treated.

As the hydra-jet treating of the formation continues, the tubing string 12 and the self-decentralized hydra-jet tool 10 may be rotated relative to the axis of the well bore 134 by manually rotating the tubing string 12 from the ground surface dry suitable means such as a hand wheel 146 or the like secured to the upper end portion 136 of the tubing string 12. The vertical position of the jet treating head assembly 14 relative to the formation being treated may be readily adjusted by raising or lowering the tubing string 12 by means of the cable 138 either during the jet treating operation or between various stages of the jet treating operation to provide selective interval treatment.

Various pressurized treating fluids may be employed with the self-decentralized hydra-jet tool 10 such as acids and abrasive laden liquids depending on the nature of the formation being treated and the type of well stimulation required.

In those cases when it is known that the zone to be hydra-jet treated is a definite distance above the bottom of the well bore, the tubing string 12, with the hydra-jet tool 10 telescopically retracted or nested therein, may be lowered within the well bore until the jet treating head assembly 14 contacts the bottom of the well bore and then raised an amount equal to the height of the zone to be treated above the bottom of the well bore plus the length of the flexible conduit assembly 18 to properly position the tubing string vertically within the well bore. The hydra-jet tool 10 may then be extended and operated in the manner as described above.

Figure 5:
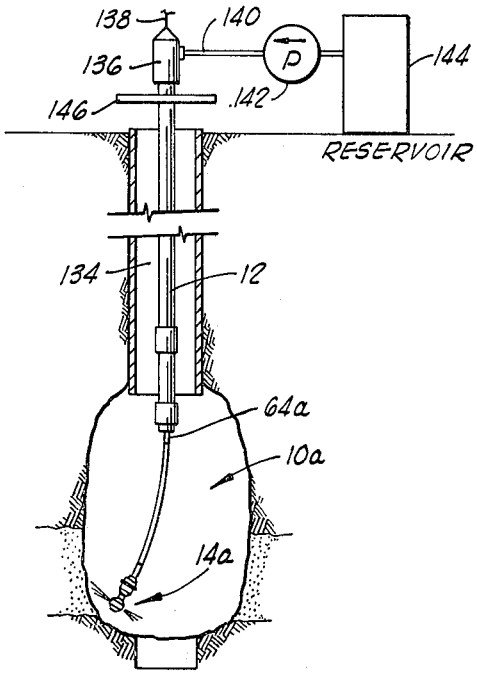
FIG. 5 is a diagrammatical elevational view of a self-decentralizing alternate embodiment of the present invention positioned in a well bore, telescopically extended relative to the tubing string and transversely self-decentralized relative to the well bore axis into close proximity to the formation face being treated.

DESCRIPTION OF THE EMBODIMENT OF FIGS. 2C and 5

In FIG. 2C it will be seen that the positioning of the treating nozzle passageway 28 and the reaction nozzle passageways 32 and 34 in the slightly modified jet treating head assembly 14*a* differs slightly from those configurations illustrated in FIGS. 2A and 2B. The passageway 38 of the nozzle insert 36 associated with the treating nozzle 28 is in substantial alignment with the passageway 38 of the nozzle insert 36 associated with the reaction nozzle passageway 34. The passageway 38 of the nozzle insert 36 associated with the reaction nozzle passageway 32 is positioned in laterally spaced, parallel alignment with the passageway 38 associated with the reaction nozzle passageway 34 and, therefore, is not in alignment with the passageway 38 associated with the treating nozzle passageway 28. This alignment of nozzle passageways illustrated in FIG. 2C provides not only a reaction force differential acting on the jet treating head assembly 14*a* as described above, but also provides a reaction force couple which tends to rotate the jet treating head assembly 14*a* in a counterclockwise direction as viewed in FIG. 2C when pressurized treating fluid is ejected through the passageways 38 thereof.

Referring now to FIG. 5, there is shown a self-decentralized hydra-jet tool 10*a* differing only slightly from the hydra-jet tool 10 described above and illustrated in a position substantially identical to that illustrated in FIG. 4C. The hydra-jet tool 10*a* employs the jet treating head assembly 14*a* illustrated in FIG. 2C and further employs a slightly modified hose fitting 64*a* connecting the upper end portion 58 of the flexible tubular conduit member 56 to the lower end portion 70 of the lower tubular member 66 of the tubular support assembly 20. The modified hose fitting 64*a* comprises a high-pressure swivel conduit permitting the free rotation of the jet treating head assembly 14*a* relative to the tubular support assembly 20 substantially about the axis of the well bore in response to the reaction force couple applied to the jet treating head assembly 14*a* by the jet reaction forces described above. It will be understood that such a high-pressure swivel conduit may be positioned anywhere intermediate the jet treating head assembly 14*a* and the tubular support assembly 20.

Operation of the Embodiment of FIGS. 2C and 5

The operation of the self-decentralized hydra-jet tool 10*a*, illustrated in FIGS. 2C and 5, is substantially identical to that described above for the hydra-jet tool 10. The hydra-jet tool 10*a*, however, provides automatic self-rotation of the jet treating head assembly 14*a* relative to the axis of the well bore through the jet reaction force couple applied to the jet treating head assembly 14 when pressurized jet treating fluid is ejected from the treating and reaction nozzle passageways 28, 32 and 34 through their respective nozzle inserts 36. Manual rotation of the tubing string 12 within the well bore 134 may also be obtained by means of the hand wheel 146 secured to the upper end of the tubing string 12.

It will be seen from the foregoing that the self-decentralized hydra-jet tool of the present invention provides distinct advantages over the known prior art devices. Typical uses of the invention may be found in the removal of damage found in cased and open holes. The invention is well adapted for the removal of scale, hydrocarbon deposits, previous well treating residues, and work-over fluids and solids found in various well bores.

Other uses of the invention will be found in typical open hole treatments where the invention is well adapted to provide improved stimulation and selective interval treatment of the formations being serviced.

The hydra-jet tool of the present invention is also well adapted for use in multi-stage fracture initiation.

Changes may be made in the construction and arrangement of parts or elements of the various embodiments disclosed herein without departing from the spirit and scope of the invention as defined in the following claims.

What is claimed is:

1. Apparatus for use with a source of pressurized treating fluid for jet treating well bores or the like, comprising:

a flexible conduit positionable within the well bore and having an upper end portion and a lower end portion;

first connecting means on the upper end portion of said flexible conduit for connecting said conduit in communication with the source of pressurized treating fluid;

a jet treating head having a cavity formed therein and connecting means formed thereon for connecting the lower end portion of said flexible conduit to said jet treating head in communication with the cavity formed therein;

first treating nozzle means formed in said jet treating head and extending outwardly from the cavity therein in a first direction for ejecting pressurized treating fluid therethrough in the first direction towards a point of contact with said well bore and exerting a reaction force on said jet treating head in a second direction opposite said first direction; and second decentralizing nozzle means formed in said jet treating head and extending outwardly from the cavity in the second direction for ejecting pressurized treating fluid therethrough from said jet treating head in the second direction and exerting an opposite reaction force in the first direction on said jet treating head greater than the opposite reaction force in the second direction associated with said first treating nozzle means.

2. The apparatus as defined in claim 1 characterized further to include:

means engageable with said flexible conduit for rotating said flexible conduit within the well bore and thereby rotating said jet treating head.

3. The apparatus as defined in claim 1 characterized further to include:

swivel conduit means interposed therein intermediate said jet treating head and said first connecting means for permitting the free rotation of said jet treating head relative to the well bore substantially about the axis of the well bore; and wherein said first and second nozzle means are positioned such that the opposite reaction forces associated with said first and second nozzle means and exerted on said jet treating head exert a force couple on said jet treating head whereby said jet treating head is rotated relative to said well bore facilitated by said swivel conduit means.

4. The apparatus of claim 1, further comprising:

a housing having an upper end portion, a lower end portion and means for securing said housing to the lower end portion a tubing string in substantially sealed coaxial alignment therewith;

a tubular member, having an upper end portion and a lower end portion, slidably held within the housing and having limit means for engaging the housing so as to limit the downward movement of said tubular member within the housing and having annular seal means formed on the outer periphery thereof intermediate the limit means and lower end portion thereof for sealingly engaging the inner surface of said housing when the limit means engages said housing;

second connecting means, forming a part of said first connecting means, for connecting the lower end portion of said tubular member to the upper end portion of said flexible conduit to provide communication therebetween; and releasable connecting means for connecting said jet treating head to said housing and for releasing said head from connection with said housing upon the application of pressurized fluid of a predetermined fluid pressure to the upper end portion of the tubing string.

5. The apparatus as defined in claim 4 characterized further to include:

filter means connected to said tubular member for filtering the pressurized fluid flowing from the tubing string into and through said tubular member, flexible conduit, tubular adaptor means, jet treating head and first and second nozzle means.

6. Apparatus, for use with a source of pressurized treating fluid for jet treating a surrounding surface such as a well bore or the like, comprising:

a flexible conduit positionable within the well bore and having an upper end portion and a lower end portion;

first connecting means on the upper end portion of said flexible conduit for connecting said conduit in communication with the source of pressurized treating fluid;

a jet treating head having a cavity formed therein and connecting means formed thereon for connecting the lower end portion of said flexible conduit to said jet treating head in communication with the cavity formed therein;

first treating nozzle means, formed in said jet treating head and extending outwardly from the cavity therein in a first direction, for ejecting pressurized treating fluid therethrough in the first direction and exerting a reaction force on said jet treating head in a second direction opposite said first direction;

second decentralizing nozzle means, formed in said jet treating head and extending outwardly from the cavity in the second direction opposite the first direction of said nozzle means, for ejecting pressurized treating fluid therethrough from said jet treating head in the second direction and for producing a greater opposite reaction force in said first direction than the opposite reaction force of said first nozzle means, thereby decentralizing said jet treating head in said first direction and moving said treating nozzle means closer to the surrounding surface;

housing means for surrounding at least a portion of said flexible conduit;

means for securing said housing to the lower end portion of a tubing string thereabove;

a tubular member, connected to said jet treating head, for being slidably held within the housing, said tubular member having limit means for engaging the housing and limiting downward movement of said tubular member within said housing;

annular seal means formed on the outer periphery of said tubular member intermediate the limit means and lower end portion thereof for sealingly engaging the inner surface of said housing when the limit means engages said housing;

second connecting means, forming a part of said first connecting means, for connecting the lower end portion of said tubular member to the upper end portion of said flexible conduit to provide communication therebetween; and shearable means for shearably interconnecting said housing to said jet treating head and flexible conduit in a first upper position preventing decentralization of said jetting head and for shearing said interconnection upon the application of a predetermined pressure to an upper end portion of said tubing string so as to allow said jet treating head and flexible conduit to move downward to a second lower position causing said limit means to engage said housing and allowing decentralization of said jet treating head.

7. The apparatus as defined in claim 6 characterized further to include:

seal means carried by said jet treating head for providing sealing engagement between said head and said housing when said jet treating head is releasably secured to said housing.

8. The apparatus as defined in claim 6 wherein said flexible conduit is characterized further as being formed of reinforced elastomeric hose.

9. The apparatus as defined in claim 4 characterized further to include:

means engageable with the tubing string for rotating the tubing string within the well bore.

10. The apparatus as defined in claim 4 characterized further to include:

swivel conduit means interposed therein intermediate said jet treating head and said tubing string for permitting substantially free rotation of said jet treating head relative to said tubing string substantially about the axis of the well bore; and wherein at least one of said first and second nozzle means is non-radially positioned for cooperating with the other of said first and second nozzle means so as to exert a force couple on said jet treating head and rotate said jet treating head relative to said tubing string facilitated by said swivel conduit means.

11. Apparatus for use with a source of pressurized treating fluid for jet treating a formation penetrated by a well bore, comprising:

a flexible conduit positionable within the well bore and having an upper end portion and a lower end portion;

connecting means on the upper end portion of said flexible conduit for connecting said conduit in communication with the source of pressurized treating fluid;

a jet treating head having a cavity formed therein and connecting means formed thereon for connecting the lower end portion of said flexible conduit to said jet treating head in communication with the cavity formed therein;

treating nozzle bore means, formed in said jet treating head, for communicating between the cavity and the exterior thereof and extending outwardly from the cavity in a first direction toward a point of contact with said formation; and at least two reaction nozzle means, formed in said jet treating head, for communicating between the cavity and the exterior thereof and each for extending outwardly from the cavity in a direction substantially opposite to the first direction of said treating nozzle bore and for forcing said treating nozzle bore into contact with said formation, the cross-sectional areas of each of said reaction nozzle bores being substantially equal to the cross-sectional area of said treating nozzle bore.

12. The apparatus as defined in claim 11 characterized further to include:

means engageable with said flexible conduit for rotating said flexible conduit within the well bore and thereby rotating said jet treating head.

13. The apparatus as defined in claim 11 characterized further to include:

swivel conduit means interposed therein intermediate said jet treating head and said connecting means for permitting the free rotation of said jet treating head relative to the well bore substantially about the axis of the well bore; and wherein the treating bore means and the reaction nozzle bores means are aligned relative to one another such that the opposite reaction forces associated therewith and exerted on said jet treating head when pressurized treating fluid is ejected therethrough exert a force couple on said jet treating head whereby said jet treating head is rotated relative to said well bore facilitated by said swivel conduit means.

14. A method of jet treating the side of a zone of a well or the like with pressurized fluid, comprising the steps of:

A supporting a jet treating head within said zone of said well;

B supplying pressurized fluid to said head;

C decentralizing the jet treating head by the reaction of unbalanced fluid jets so as to urge the jet treating head toward a side of said zone; and D directing a treating fluid jet adjacent to said side toward said side to thereby jet treat said side.

15. The method as defined in claim 14 characterized further to include the additional step of:

E rotating the jet treating head substantially about the axis of said zone of said well so as to move the fluid jet adjacent to said side of said zone adjacent to other sides of said zone so as to treat said other sides.

16. The method as defined in claim 15 characterized further to include the additional steps of:

F changing the depth at which the jet treating head is supported within the well bore; and G repeating steps (B), (C), (D) and (E) to treat another zone of the formation.

17. A method of jet treating the face of a formation penetrated by a well bore or the like with pressurized treating fluid, comprising the steps of:

A releasably supporting a jet treating head on the lower end portion of a tubing string with a flexible conduit communicating with the jet treating head and extending upwardly within the tubing string;

B lowering the tubing string into a well bore to a depth a small distance above a formation to be treated;

C applying pressurized fluid to the upper end of the tubing string;

D releasing the jet treating head from the lower end of the tubing string in response to the application of pressurized fluid thereto;

E supporting the jet treating head within the well bore below the tubing string on the flexible conduit in fluid communication with the lower end portion of the tubing string and the source of pressurized fluid, substantially unrestrained with respect to generally transverse movement within the well bore, and operable to move generally transversely relative to the well bore toward the face of the formation to be treated;

F ejecting unbalanced pressurized treating fluid jets outwardly from the jet treating head in two substantially opposite directions generally transverse to the well bore, the force of the fluid ejecting in one direction being greater than the force of the fluid ejecting in the opposite direction;

G creating a force differential on the jet treating head by the reaction of the unbalanced treating fluid jets thereby urging the jet treating head toward the face of the formation to be treated in response to the force differential; and H directing the treating fluid jet adjacent to the face of the formation onto the formation to treat the formation.

18. The method as defined in claim 17 characterized further to include the additional step of:

I rotating the jet treating head substantially about the axis of the well bore to direct the treating fluid jet adjacent to the face of the formation onto the formation surrounding the well bore to treat the formation.

19. The method as defined in claim 18 characterized further to include the additional steps of:

J changing the depth of the tubing string and jet treating head within the well bore; and K repeating steps (F), (G), (H) and (I) to treat another zone of the formation.

* * * * *